US005351620A

United States Patent [19]

Becheau et al.

[11] Patent Number: 5,351,620

[45] Date of Patent: Oct. 4, 1994

[54] TROLLEY CONVEYOR SYSTEM HAVING A HELICALLY TWISTED TRACK FOR A POSITIONABLE MOBILE DEVICE MOUNTED IN THE TROLLEY AXLE

[76] Inventors: Vincent Becheau; Marie-Laure Bourgeois, Ancienne Ecole, 24700 Saint-Geraud-de-Corps, France

[21] Appl. No.: 852,222

[22] PCT Filed: Dec. 4, 1990

[86] PCT No.: PCT/FR90/00881

§ 371 Date: Jun. 1, 1992

§ 102(e) Date: Jun. 1, 1992

[87] PCT Pub. No.: WO91/08420

PCT Pub. Date: Jun. 13, 1991

[30] Foreign Application Priority Data

Dec. 6, 1989 [FR] France ..... 89 16136

[51] Int. Cl.[5] ..... B61B 3/00; E01B 25/00

[52] U.S. Cl. ..... 104/296; 104/89; 104/106; 105/30; 105/155; 191/53; 191/63; 362/61; 362/285

[58] Field of Search ..... 104/89, 93, 94, 106, 104/107, 296, 56; 105/30, 49, 136, 155; 191/53, 57, 63; 362/61, 78, 285, 286, 287

[56] References Cited

U.S. PATENT DOCUMENTS

| | | | |
|---|---|---|---|
| 2,959,138 | 11/1960 | Foster | 104/296 X |
| 3,345,471 | 10/1967 | Kilburg | 104/93 X |
| 3,681,542 | 4/1972 | Johnson | 104/89 X |
| 4,023,503 | 5/1977 | Grop | 105/30 |
| 4,170,942 | 10/1979 | Achreka | 104/56 |
| 4,430,694 | 2/1984 | Koivumaki et al. | 362/285 X |
| 4,519,021 | 5/1985 | Oram | 362/285 X |
| 4,553,193 | 11/1985 | Evans | 362/285 X |

FOREIGN PATENT DOCUMENTS

| | | |
|---|---|---|
| 3620920 | 1/1988 | Fed. Rep. of Germany . |
| 3819524 | 8/1989 | Fed. Rep. of Germany . |

*Primary Examiner*—Robert J. Oberleitner
*Assistant Examiner*—S. Joseph Morano
*Attorney, Agent, or Firm*—Sandler, Greenblum & Bernstein

[57] ABSTRACT

Carrier system for a mobile device positionable in various directions in space, such as a directive light source, including a trolley which can move along a guide ramp. The ramp includes two helical rails turning about a given longitudinal axis, and the trolley includes a pair of axles with parallel axes holding the ramp therebetween. Each axle is provided with a central body engaging with an associated face of the ramp by wheels capable of running the ramp and guiding the axles when the wheels move along the ramp, with which the wheels are held in contact by an elastic connecting member pulling them towards each other. The light source is fixed to the central body of one axle, and the central body is coupled in rotation with the wheels of the axle.

19 Claims, 7 Drawing Sheets

TROLLEY CONVEYOR SYSTEM HAVING A HELICALLY TWISTED TRACK FOR A POSITIONABLE MOBILE DEVICE MOUNTED IN THE TROLLEY AXLE

BACKGROUND OF THE INVENTION

1. Field of the Invention

The present invention relates to a carrier system for a positionable mobile device, in various directions in space, comprising a trolley movable along a guide ramp, the guide ramp acting as a support for the device. This device can be any device emitting or receiving rays provided with a directive nature, such as a light source emitting luminous beam, a scanner providing a directional characteristic, or any other device that has to adopt various positions during its functioning, such as a material handling device ensuring the gripping of an object or an article and then depositing it at another place.

2. Discussion of Background Information

Currently, in the field of lighting, systems are known which comprise a horizontal electric lamp along which a journalled support equipped with a socket and a reflector receiving an electric bulb can slide. Such a system has several disadvantages. Notably, the system requires displacement means in each of the horizontal and vertical directions, making this a complex and expensive system, which however, only enables the system to perform relatively slow maneuvers because of the decomposition of the movement and stop time necessary to pass from one displacement direction to another.

SUMMARY OF THE INVENTION

The object of the present invention is to overcome the disadvantages of known systems by creating a system that is simple and inexpensive, and enables displacement of a device positionable in such a way that it can be easily directed along any direction, and ensures an omni-directional scanning of space.

To this end, in a system according to the invention, the ramp has a shape of a ribbon twisted helically about a rectilinear or possibly incurred axial line, and the trolley is constituted by a pair of axles having substantially parallel axes holding the ramp between them in a sandwich, against which they are applied by virtue of elastic connecting means that bias them toward each other, whereas the positionable device is mounted in one of the two axles, so as to turn with it about its own axis, either permanently or intermittently.

In a system conceived as such, a displacement of the trolley along the helical ramp is accompanied by a double rotational movement of the positionable device, or in other words about the axial line of the ramp, because of its helical shape, and about the axis of the axle that beds such device, because of the rotation of this axle moving on the ramp. Thus, the system enables a simple and easy positioning of the positionable device in an omni-directional manner, any journalled complicated assembly becoming useless henceforth. When this device is a source emitting luminous beam, the trolley need only be displaced on its ramp to be able to light up any point in space.

It must be ensured that the two axles of the trolley have respective moment of weight substantially equal with respect to the axis of the ramp, so that the trolley is always in equilibrium, not affected by its angular position about the axis of the ramp.

In one embodiment, the ramp has a continuous slot along its axial line and the elastic connection means of the two axles comprise a central elastic link passing through this slot, thus ensuring the guidance of the axles along the ramp.

In another embodiment, each of the axles comprises a central body that rests on a respective surface of the ramp by wheels capable of rolling on it or possibly sliding on it by guiding the axles when they are displaced along the ramp; whereas, the device that is positionable is affixed to the central body of one of the two axles, this central body being rotationally coupled with the wheels of the latter either permanently or intermittently.

A manual displacement means can be attached to the trolley along the ramp, such as a cord following the axial line of such ramp, and being able to be manually moved by a translational movement. It will then be necessary for the wheels of the axle whose central body bears the positionable device to be affixed to the central body, such that while rolling on the ramp these wheels rotationally drive the positionable device about the axis of the axle.

In a variation, the trolley can be equipped with a remote driving motor, mounted in the central body of a first axle and comprising a housing and an outlet shaft, one of these two elements being stopped from turning with respect to the axis of the second axle; whereas, the other element of the motor is coupled in rotation with the wheels of one of the axles, that constitute the motor wheels for the trolley. In a preferred embodiment, the motor wheels of the trolley are those of the second axle and a coupling of the motor to these wheels is done via at least one lateral transmission assembly comprising either one belt passing on the pulleys or a gear train; whereas, the positionable device cited above is affixed to the central body of the second axle.

Advantageously, the positionable device is mounted in the central body of the axle whose wheels are the motor wheels of the trolley and each of these wheels is coupled to the central body by means of coupling means enabling a free mutual rotation on a predetermined angle, which can only be slightly less than 360°. This arrangement, that has the effect of momentarily disassociating the two rotational movements to which the positionable device is subjected, enables the latter to be turned almost about 360° around axis of the axle, the trolley remaining unmoving.

In a special embodiment, the ramp comprises two equal rigid rails shaped helically, and diametrically opposed with respect to their common axis, on which the wheels of the trolley take support and by which they are guided. Such a structure enables a substantial reduction in the masking effect of the ramp on the beam emitted or received by the positionable device. Besides, these two helical rails are preferably metallic and insulated electrically from one another, so as to constitute an electric connecting track, via wheels—also metallic and insulated—of at least one of the two axles, or via wipers, for an electric device located at least aboard the trolley, such as the positionable device, the drive motor, etc. If necessary, the ramp can be provided with at least one conducting crank extending along its longitudinal axis or turning about helically around this axis in the same direction and at the same speed as the ramp, the trolley being equipped with at least one contact plug remaining in contact with said conducting crank. This arrangement enables the electric connecting paths along the ramp to be multiplied, and can be used for several electric devices placed aboard one or more trolleys.

The system according to the present invention enables, in a simple and easy manner, the positioning in any direction in the surrounding space of all sorts of devices, whether they be sources or directive receivers of rays, or material handling elements embarked aboard a trolley circulating in a ramp such as defined above, and this is done by virtue of a unique progressive movement of the trolley along the ramp. It can therefore be used in numerous applications especially:

- lighting of public or private areas, commercial or industrial areas, or on stage, with a view to creating a changing environment or special scenic effects, or even for lighting a specific point;
- an electronic protection of a space by exploration of all its parts by means of a directive sensor animated by an omni-directional scanning;
- material handling or machining devices for a diverse number of objects.

Other special characteristics and advantages of the invention will become more apparent upon reading the description that follows, with respect to the annexed drawings, given as non-limiting examples.

DETAILED DESCRIPTION OF THE PREFERRED EMBODIMENTS

Figure 1:
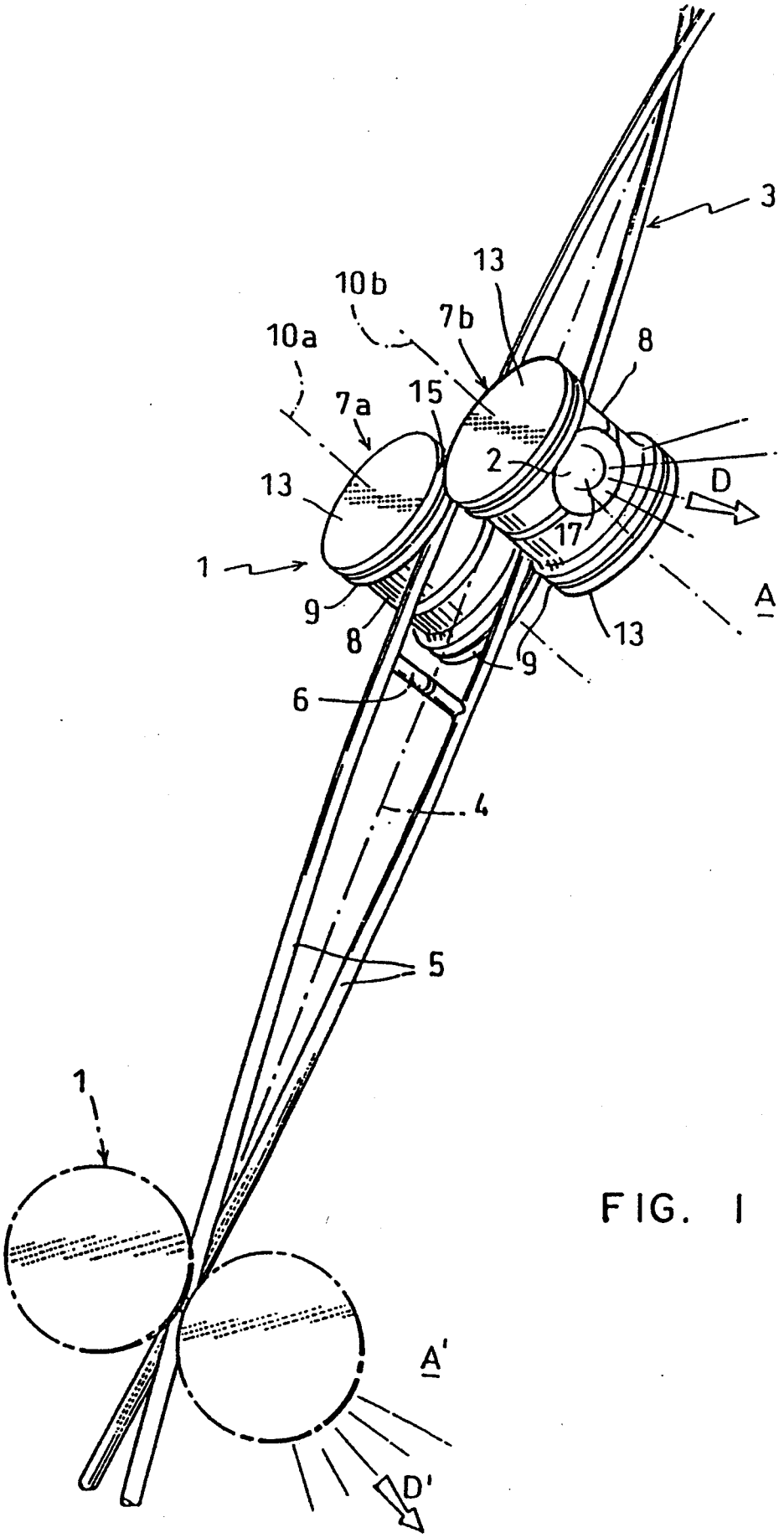
FIG. 1 represents a perspective view of a portion of the system according to the invention.
Figure 2:
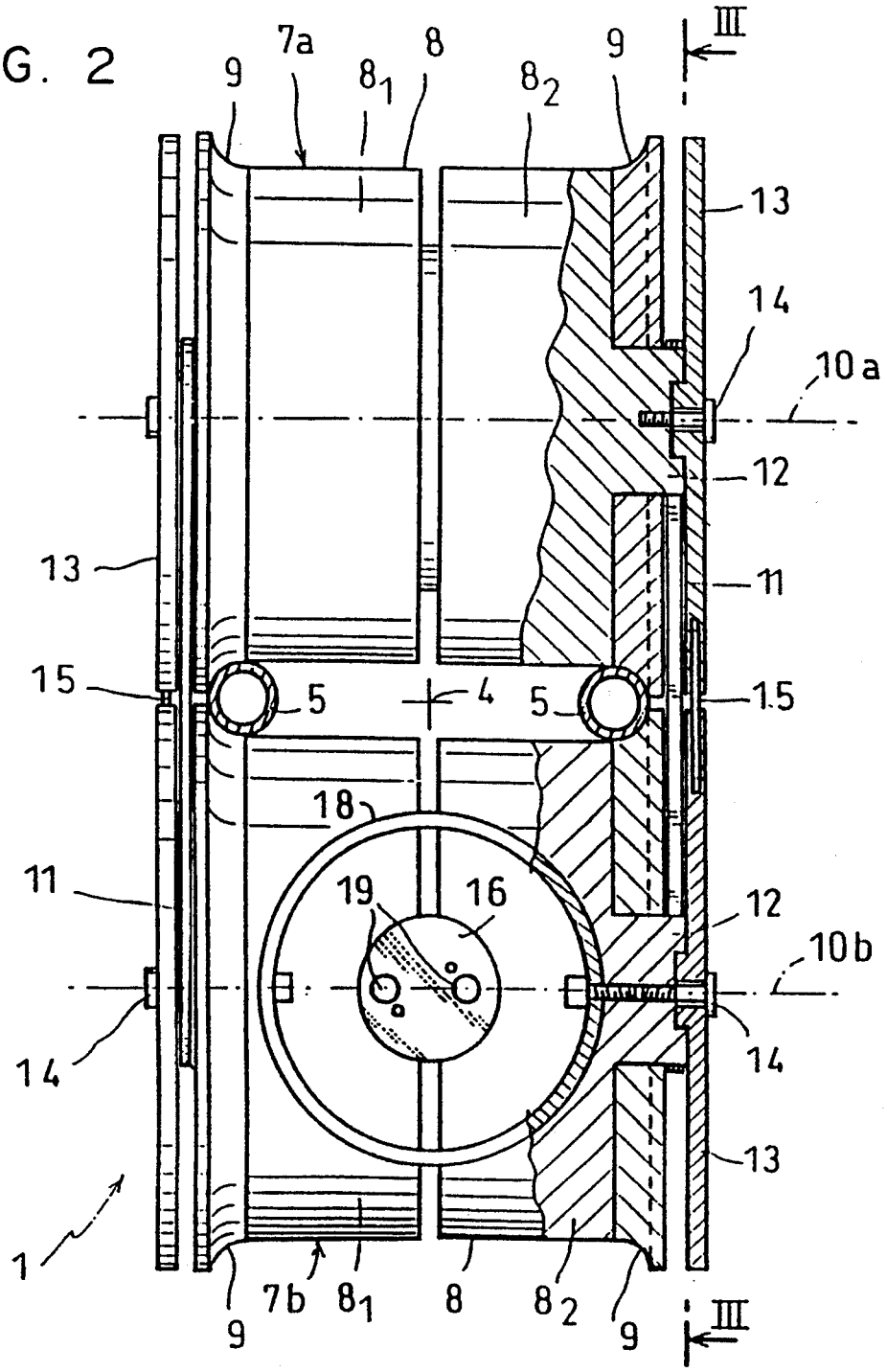
FIG. 2 represents a front elevation, acting in large scale, of a trolley of the system of FIG. 1.
Figure 3:
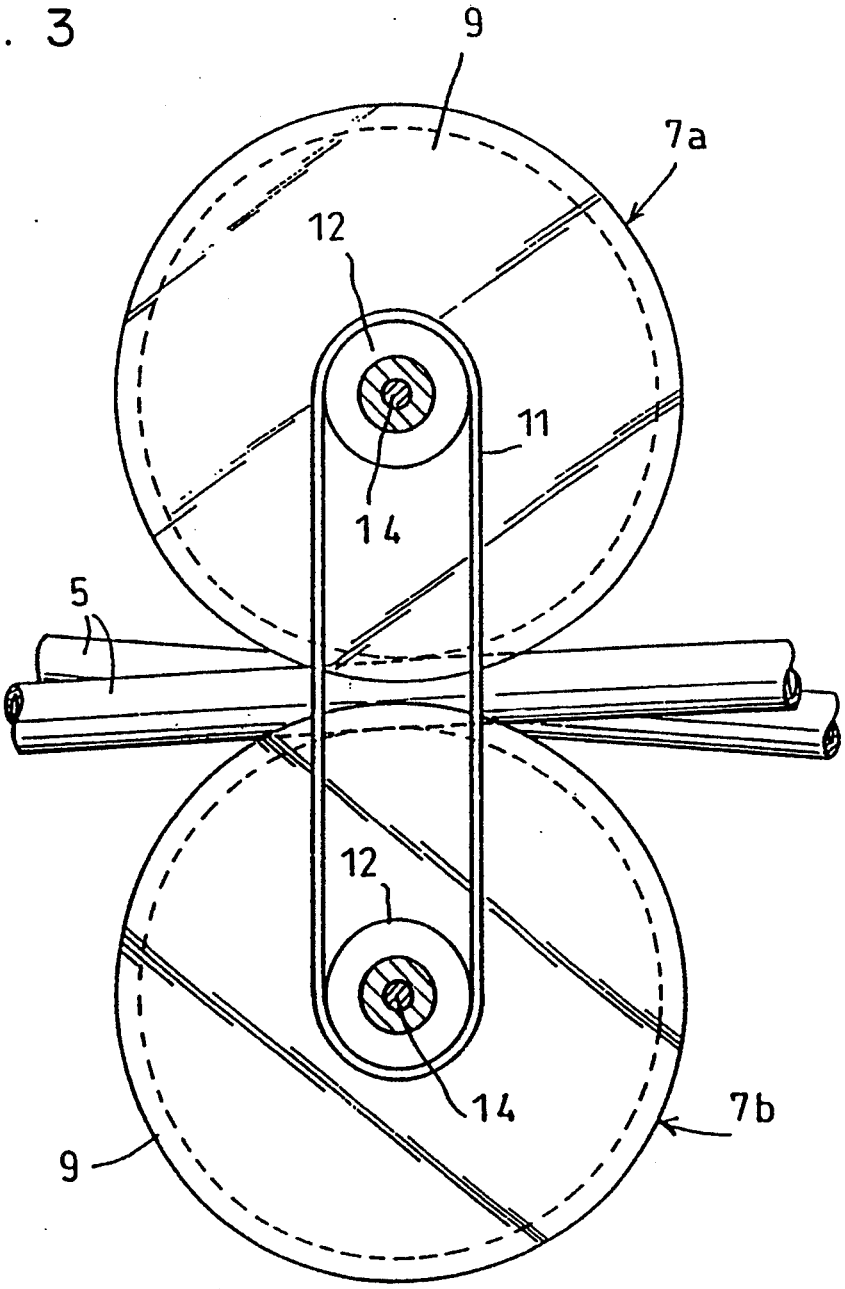
FIG. 3 represents a sectional view along line III—III of the object of FIG. 2.

In FIG. 1, there is shown a portion of a mobile lighting system comprising a trolley 1 bearing a positionable device constituted by a directive light source 2, that can be displaced along a guide ramp 3. This guide ramp, having a twisted configuration about its axis 4, is constituted by two nonlinear rails 5, shaped helically and equal, turning about their common axis 4 in diametrically opposed locations with respect to the axis. These two rails are mutually affixed by spacers 6 located further away. Trolley 1 is composed of two axles *7a, 7b* that are similar, and mutually located in front and on either side of the two surfaces of ramp 3 materialized by rails 5, and are elastically tightened and reunited by elastic links 11 (FIGS. 2 and 3) that keep them applied against rails 5.

Each axle *7a, 7b* is composed of a central body 8, flanked by a pair of wheels 9, respectively, having a same axis 10*a*, 10*b* and affixed to central body 8. It is by means of these wheels that axles *7a, 7b* take support and roll on rails 5. Each central body 8 comprises a pair of hubs 12 that project laterally outside wheels 9. On these hubs 12, located on the same side of trolley 1, an elastic bracelet constituting one of links 11, mentioned previously, passes. To avoid bracelets 11 from coupling the two axles *7a, 7b* in the same direction rotationally, when they have to turn in inverse directions and roll on rails 5, it must be insured that the rubbing force between each bracelet 11 and hubs 12 is weak, either by choice of materials, or by positioning a ring turning freely between a hub and the corresponding bracelet.

Figure 6:
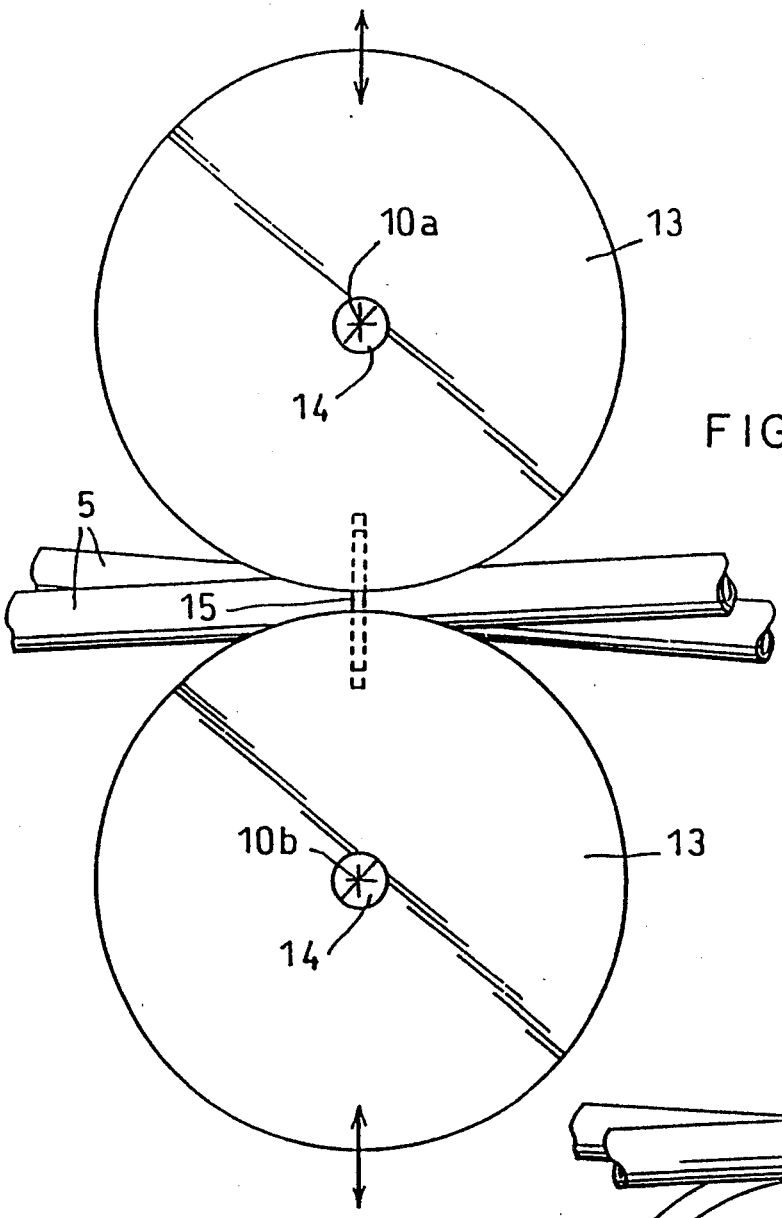
FIG. 6 represents a view along arrow VI of the object of FIG. 4.

The wheels 9 located on the same side of trolley 1 are covered by a pair of shields 13, formed by disks of the same diameter as the wheels, that are mounted on hubs 12 by central pivots 14 located on axes 10*a*, 10*b*, respectively, of axles *7a* and *7b*. When axles *7a, 7b* turn about their axes 10*a*, 10*b* by rolling on rails 5, shields 13 remain immobile, being mutually linked so as to not be able to turn about axes 10*a*, 10*b*, respectively, without however being completely affixed, which would go against the action of elastic bracelets 11. In practice, shields 13 of each lateral pair are connected in their contiguous regions by a small bar 15 located in their common plane and in the plane of the axes 10*a*, 10*b* with respect to which each shield 13 can slide slightly (see FIG. 6).

One of the axles, namely axle *7b*, is equipped with a socket 16 adapted to receive an electric bulb 17 provided with a reflector 26 (FIG. 5), the assembly constituting a light source 2 emitting a luminous beam in a direction D radial with respect to the axis 10*b* of axle *7b*. This bulb 17 is supplied with electric current by rails 5 and wheels 9 of the axle. To this end, the central body 8 is manufactured of two metallic elements $8_1$, $8_2$ insulated electrically by a connecting ring 18 made of an insulating material. Each of the electrically connection broaches 19 of socket 16 is connected to one of the respective elements $8_1$, $8_2$ and, via corresponding wheel metallic wheels 9, to one of the two rails 5, manufactured of metal, with spacers 6 being electrically insulated. The other axle *7a*, that is not provided with a socket 16, has a structure that is similar so as to not short circuit rails 5.

When trolley 1 is displaced along helical ramp 3 constituted by the pair of rails 5, each of axles *7a* and *7b* rolls on the rails by turning about its axis 10*a*, 10*b*; whereas, the trolley progresses by turning about axis 4 of the helical ramp. Thus, when the trolley passes, for example, from position A to position A' (FIG. 1), the initial direction D of the luminous beam is changed into a direction D' that is deduced from the preceding one by a double rotation about axis 10*b* of axle *7b* and about axis 4 of ramp 3. It can be conceived that by making trolley 1 move along the ramp, the direction D of the luminous beam scans all the surrounding space and this practically without any disturbances from ramp 3, which, composed of two rails 5 having weak sections presents an ultimate transparency, e.g., light can pass through the opening between the two rails 5".

The displacements of trolley 1 can be obtained by direct manual action. Activation can also be provided by means of a cord similar to a maneuvering cord for curtains, moving along axis 4 of ramp 3, trolley 1 being connected by shields 13 to this cord. The cord can be activated manually or by means of an electric motor.

If, in the chosen position of trolley 1 on ramp 3, direction D of the luminous beam needs to be modified, it is possible to turn axle *7b*, without displacing trolley 1, the wheels 9 of such axle sliding without rolling on rails 5.

Figure 4:
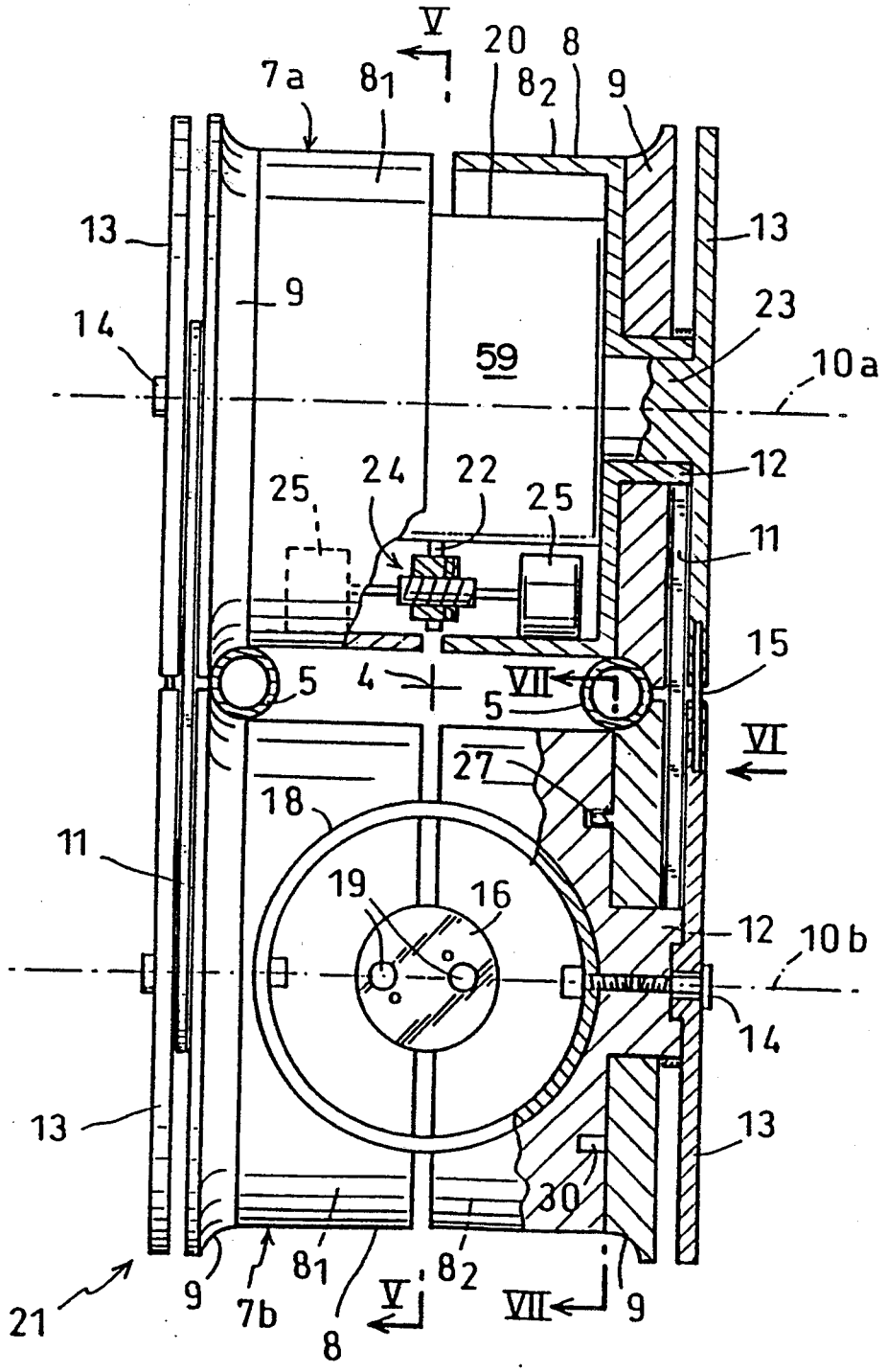
FIG. 4 represents, in a manner of FIG. 2, a motorized version of the trolley.
Figure 5:
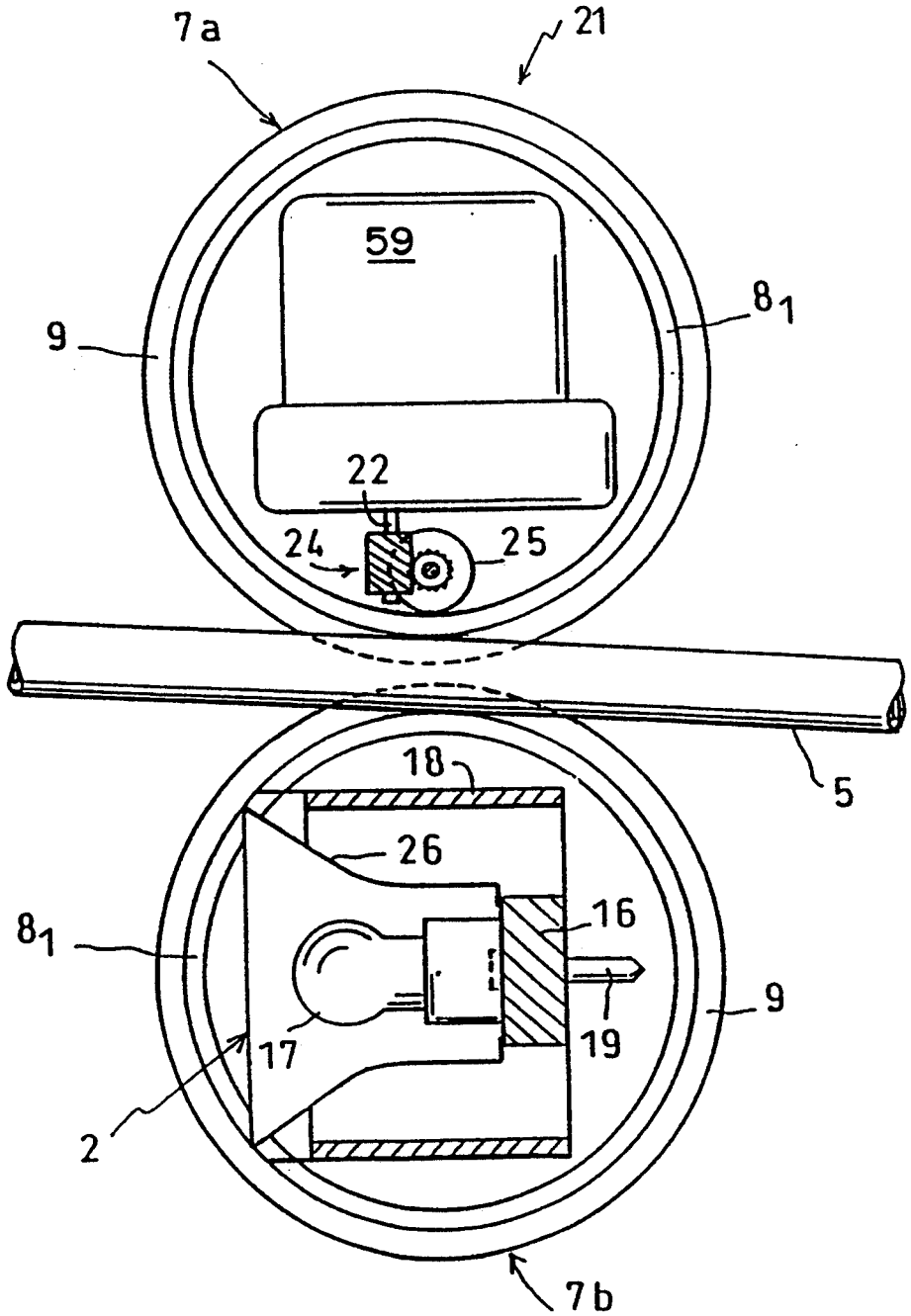
FIG. 5 represents a section along line V—V of the object of FIG. 4.

In the variations illustrated in FIGS. 4 and 5, the displacements of the trolley, designated here by the reference numeral 21, are obtained by means of an electric motor 59 incorporated into one of the axles, namely axle *7a*, which is not provided with light source 2. The similar elements of trolleys 1 and 21 have been designated by the same reference numerals. Motor 59 is arranged in such a way so as to drive in rotation axle *7b* in its wheels 9 about axis 10*b* of such motor, and thus, make it roll on rails 5. As we will see later, wheels 9 are no longer affixed to central body 8 of axles *7a, 7b*.

Motor 19 comprises a housing 20 and an outlet shaft 22. Housing 20 is affixed to shields 13 that flank the latter by tips 23 passing through hubs 12 of axle *7a*, which, to this end, are hollow. The arrangement is such that a central body 8, composed of two symmetrical elements $8_1$, $8_2$ and wheels 9 can turn independently about their common axis 10*a*, but not tips 23, nor consequently, housing 20 of the motor, because of the connection imposed upon them by the two pairs of shields 13 with respect to axis 10*b* of the other axle *7b*.

Figure 7:
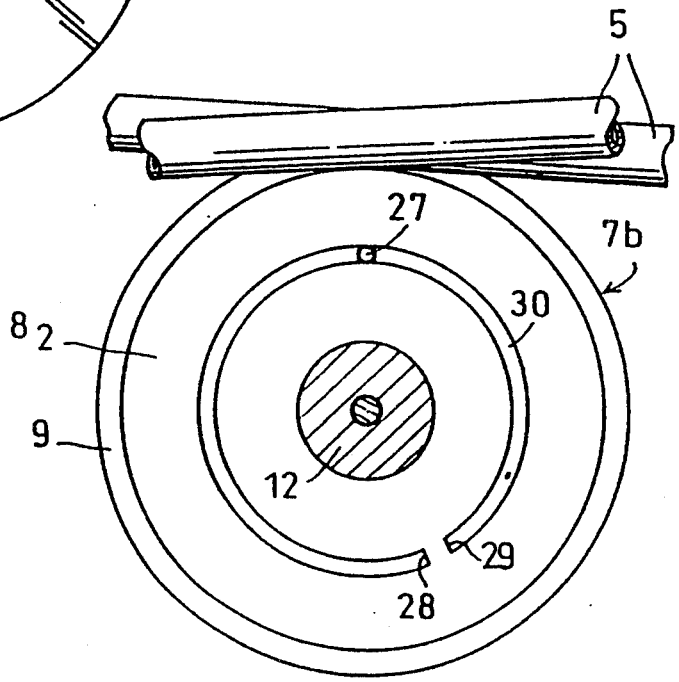
FIG. 7 represents a section along line VII—VII of the object of FIG. 4.

The outlet shaft 22 of motor 59 activates rotationally, via geared transmission 24 and pair of rollers 25, the pair of elements $8_1$, $8_2$ comprises central body 8 of axle *7b*, whose rotational movement is transmitted via elastic links 11—coupled in rotation in this motorized version of the trolley with hubs 12 of the two central bodies 8—to the central body 8 of axle *7b* bearing socket 16. The elements $8_1$, $8_2$ of this central block rotationally drive wheels 9 not directly, but by means of a lug 27 affixed to each wheel 9 from which it projects in an offset position and that comes in abutment against ends 28, 29 of the circular groove 30 hollowed in the flank of element $8_1$ or $8_2$ corresponding, on a little less than 360°, where lug 27 can circulate freely from one to the other of its ends (FIG. 7).

When motor 59 is supplied with electric current, it communicates, by rollers 25, a rotational movement to central body 8 of axle *7a* with respect to tips 23 which, as far as they are concerned, cannot turn, because of their connection to axis 10*b* of the other axle *7b* by the radial arms that constitute the lateral pairs of shields 13. The rotation of this center block causes the rotation of that of the other axle *7b*, by elastic links 11, which first turn without driving wheels 9, which enables the positioning of the light source 2 which it bears without displacement of trolley 21. Then, when one end 28 or 29 of grooves 30 comes into contact with lugs 27 of wheels 9, these are in turn driven in rotation and enable trolley 21 to advance on rails 5.

Motor 59, which is mounted in central body 8 of axle *7a* so as to respect the electric insulation of the two elements $8_1$, $8_2$ that compose it, receives its electrical current supply by rails 5, just like bulb 17 of light source 2 of axle *7b*. The activation, the rotation direction and stop of motor 19 are controlled by a control device incorporated in trolley 21, to which the correspondent orders are addressed by remote by means of coded signals transmitted either via rails 5, together with the supply current, or by wireless, infrared or ultrasound. One can also provide, on an auxiliary helical support associated to rails 5, conducting tracks for transmission of the remote orders, to which the control device of motor 59 is connected via wipers affixed to lateral shields 13 of trolley 21. According to a special embodiment that is simple, only the transmission of a start/stop order is provided, the control device of the motor being envisioned to control, with each restarting of the latter and inversion of the rotational direction. It can be observed that at each time, by virtue of coupling means 27, 30, the light source turns almost a complete revolution without moving before trolley 21 begins to advance.

For reasons of security, only low tension electrical currents (12 V or 24 V) can be transported by rails 5 or conducting tracks of ramp 3. Moreover, in order to facilitate the assembly or dismounting operations, ramp 3 is composed of elements whose length is approximately 1 meter, assembled one after another. To these helical elements, flat, non-twisted elements can be added, that can, if required, be interposed between the helical elements. One can also provide non-rectilinear elements, that are incurved however, and extend along an axial line 4 that is curved.

A same ramp 3 can receive several manual or motorized 21 trollies. In the latter case, the motors are independently controlled by remote by means of specific coded signals, either beamed towards trolley 21, or transmitted by rails 5 or by conducting tracks each of which is assigned a specific trolley 21.

Figure 8:
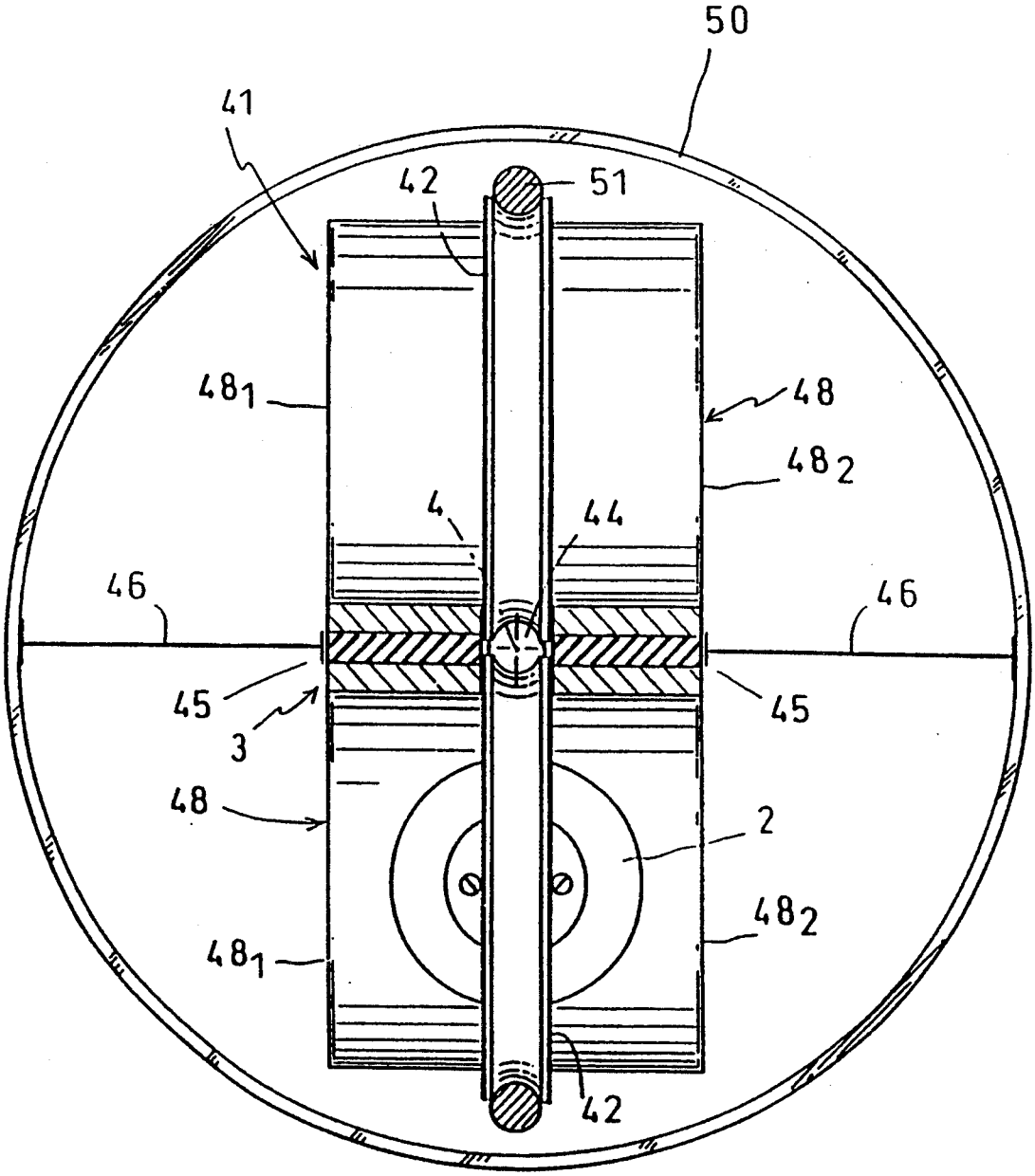
FIG. 8 represents, in the manner of FIG. 2, another embodiment.

In a variation of the embodiment of illustrated in FIG. 8, the axles of the trolley, designated here by the reference numeral 41, are constituted by rollers 48, composed of two metallic elements $48_1$, $48_2$, electrically insulated from one another. These rollers, one of which comprises a light source 2, roll on a ramp 3 formed of two flat rails 45, having rectangular section twisted helically about their axis 4. Between rails 45, a longitudinal slot 44 appears through which passes an elastic belt 51 passing idle pulley 42, each of which belongs to one of axles 48, on which it is mounted coaxially in a central location. Here, the guiding of trolley 41 along ramp 3 is ensured by belt 51 cooperating with the sides of slot 44. In order to enable the latter to be free along the entire length of the ramp, rails 45 are fixed by lateral supports 46 inside a tube 50 made of a rigid transparent material, in which trolley 41 can circulate. The fact that the system, contained in this tube, can be electrically insulated by it, enables the use of higher electric tensions, for example 220 V.

In a motorized version of this trolley, the mechanical transmission of one or the other of the axles is done not laterally, but centrally through slot 44.

We claim:

1. Bearing system for omni-directionally orientating a mobile device, comprising:

a guide ramp having a shape of a ribbon twisted helically about a rectilinear or incurved axial line;

a trolley supported by and movable along said guide ramp, said trolley comprising a pair of axles having parallel axes, with said ramp being positioned between said pair of axles;

elastic connecting means for biasing the axles of said pair of axles towards one another, each of said axles being rotatable about a respective axis on moving said trolley along said ramp; and a mobile device mounted in one of said two axles, so as to rotate with said axle about the axle, either continuously or intermittently, as said trolley moves along said ramp.

2. System as defined by claim 1, wherein said two axles of said trolley exert a respective torque about said axial line of said ramp, said torque being substantially equal.

3. System as defined by claim 2, wherein said ramp includes a continuous slot along said axial line, and said elastic connecting means comprise a central, elastic link passing through said slot.

4. System as defined by claim 2, wherein each of said two axles comprises a central body which rests on a respective surface of said ramp by wheels that are capable of rolling or sliding while guiding the axles when displaced along said ramp, and said mobile device is affixed to the central body of one of said two axles, said central body being coupled in rotation with said wheels of said one of the two axles, either continuously or intermittently.

5. System as defined by claim 4, wherein said trolley is linked to a means for manually displacing said trolley along said ramp.

6. System as defined by claim 5, wherein said means for manually displacing said trolley comprise a cord running along said axial line of said ramp, said cord being manually movable by a translational movement.

7. System as defined by claim 1, wherein said ramp includes a continuous slot along said axial line, and said elastic connecting means comprise a central, elastic link passing through said slot.

8. System as defined by claim 1, wherein each of said two axles comprises a central body which rests on a respective surface of said ramp by wheels that are capable of rolling or sliding while guiding the axles when displaced along said ramp, and said mobile device is affixed to the central body of one of said two axles, said central body being coupled in rotation with said wheels of said one of said two axles, either continuously or intermittently.

9. System as defined by claim 8, wherein said trolley is linked to a means for manually displacing said trolley along said ramp.

10. System as defined by claim 9, wherein said means for manually displacing said trolley comprise a cord running along said axial line of said ramp, said cord being manually movable by a translational movement.

11. System as defined by claim 10, wherein, in said axle comprising said central body to which said mobile device is affixed, said wheels are affixed to said central body.

12. System as defined by claim 9, wherein, in said axle comprising said central body to which said mobile device is affixed, said wheels are affixed to said central body.

13. System as defined by claim 8, wherein said trolley includes a remotely controlled driving motor mounted in said central body of the other of said two axles.

14. System as defined by claim 13, wherein said motor comprises a housing and an outlet shaft, one of said housing and said outlet shaft being stopped from turning with respect the axis of the other of said two axles, and the other of said housing and said outlet shaft is coupled in rotation with corresponding wheels of one of said two axles that constitute motor wheels for said trolley.

15. System as defined by claim 14, wherein said motor wheels of said trolley comprise wheels of the other of said two axles, and said motor is coupled to said motor wheels via at least one lateral transmission assembly, and said mobile device is affixed to said central body of the other of said two axles.

16. System as defined by claim 15, wherein said at least one lateral transmission comprises coupling elements enabling a free mutual rotation for a predetermined angle.

17. System as defined by claim 14, wherein said mobile device is mounted in said central body of the other of said two axles, and said motor wheels comprise wheels coupled to the corresponding central body with coupling elements enabling a free mutual rotation for a predetermined angle.

18. System as defined by claim 8, wherein said ramp comprises two rigid rails, equally helical, and diametrically opposed with respect to said axial line of said ramp, on which said wheels of said trolley take support, and by which said wheels are guided.

19. System as defined by claim 18, wherein said two helical rails of said ramp are metallic and electrically insulated from one another forming an electric connecting path, via said wheels on at least one of said two axles, said wheels also being metallic and electrically insulated, for an electric device at least aboard said trolley.

* * * * *